US008474203B1

(12) United States Patent
Stewart et al.

(10) Patent No.: US 8,474,203 B1
(45) Date of Patent: Jul. 2, 2013

(54) MULTISTORY RESIDENTIAL BUILDING WITH PRIVATE STAIRWAY ACCESSIBLE UNITS

(75) Inventors: Jerry W. Stewart, Dallas, TX (US); W. Bryan Thruston, Dallas, TX (US)

(73) Assignee: STB Architects and Planners, Dallas, TX (US)

( * ) Notice: Subject to any disclaimer, the term of this patent is extended or adjusted under 35 U.S.C. 154(b) by 0 days.

(21) Appl. No.: 12/789,034

(22) Filed: May 27, 2010

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |

(52) U.S. Cl.
USPC ..... 52/236.3; 52/174; 52/185

(58) Field of Classification Search
USPC ..... 52/236.3, 236.4, 174, 175, 185
See application file for complete search history.

(56) References Cited

U.S. PATENT DOCUMENTS

| | | | | |
|---|---|---|---|---|
| 2,698,973 | A | 1/1955 | Zeckendorf et al. | |
| 3,479,781 | A | 11/1969 | Johnson | |
| 3,603,047 | A | 9/1971 | Tournier | |
| 3,638,379 | A * | 2/1972 | Williams | 52/185 |
| 3,656,266 | A | 4/1972 | Tylius | |
| 3,750,354 | A | 8/1973 | Boros | |
| 3,755,974 | A | 9/1973 | Berman | |
| 3,923,096 | A | 12/1975 | van der Lely | |
| 4,003,182 | A | 1/1977 | Wokas | |
| 4,054,014 | A | 10/1977 | van der Lely | |
| 4,078,344 | A | 3/1978 | van der Lely | |
| 4,596,097 | A | 6/1986 | Stewart et al. | |
| 4,602,464 | A | 7/1986 | Medel | |
| 4,794,747 | A * | 1/1989 | Yendo | 52/236.3 |
| 4,918,889 | A | 4/1990 | Lundstrom et al. | |
| 5,109,642 | A | 5/1992 | Ayala et al. | |
| 5,809,704 | A | 9/1998 | Stewart et al. | |
| 6,058,664 | A | 5/2000 | Brownlee, III | |
| 6,155,012 | A | 12/2000 | Halbitte | |
| 6,405,496 | B1 | 6/2002 | Stewart et al. | |
| 6,550,197 | B1 | 4/2003 | Gray | |
| 7,036,281 | B2 | 5/2006 | Stewart et al. | |
| 7,497,055 | B2 | 3/2009 | Stewart et al. | |
| 7,779,586 | B2 * | 8/2010 | Stewart et al. | 52/236.3 |
| 2004/0006940 | A1 * | 1/2004 | Gray | 52/236.3 |

OTHER PUBLICATIONS

"Building With Outinord" (Outinord Universal, Inc. Website), 1999, 6 pages.

(Continued)

*Primary Examiner* — Brian Glessner
*Assistant Examiner* — Brian D Mattei
(74) *Attorney, Agent, or Firm* — Gardere Wynne Sewell LLP

(57) ABSTRACT

A multistory residential building provides private access to each unit in order to eliminate breezeways and common stairwells. If a unit is located on the first level, private access is provided by a privately used front door disposed on an end wall of the residential building. Units that are located on the second and third floors are accessed by privately used front doors on internal stairways, wherein said stairways are secluded and inaccessible to other residents and guests. The front doors of the third-floor units are located on intermediate landings wherein access to each landing is provided by a semi-private monumental stairway. The front doors located on the second and third floors are disposed on end wall opposite the end wall having the first floor doors. Accordingly, it is unnecessary to provide breezeways and common stairways connecting all the floors of each building to provide access to each unit.

19 Claims, 9 Drawing Sheets

OTHER PUBLICATIONS

"Simply Remarkable High-Rise Living" (Excelsiorliving.com Website), 2000, 7 pages, Genesis Real Estate.

Carlton Dunes, Amelia Island, FL, floor plans, 2 sheets, date unknown.

* cited by examiner

MULTISTORY RESIDENTIAL BUILDING WITH PRIVATE STAIRWAY ACCESSIBLE UNITS

BACKGROUND

Multistory multi-unit residential buildings are oftentimes constructed such that the dwelling units on each floor are accessed via limited view breezeways and stairwells. For example, it is common to construct multi-story apartment buildings such that adjacent buildings are connected via a multilevel public breezeway and stairwell(s) disposed therebetween. While this architecture allows for easy access to upper level dwelling units and requires the construction of fewer stairwells (since the upper dwelling units share common stairwells), such configurations oftentimes result in dark confined areas between the buildings and are not directly viewable from open areas, such as for example, a parking lot or street. Furthermore, the use of public breezeways and stairwells result in less "rentable" space per acre, since individual buildings must be spaced apart to allow for common breezeways therebetween. In addition, common breezeways and stairwells cannot be included in the rentable area of any particular dwelling unit.

SUMMARY

A multistory residential building is disclosed providing direct private access to each dwelling unit and eliminates common or public breezeways and stairwells. Private access to first-level units is provided by a privately used front door disposed on a front-facing portion of the building. Second and third-floor units are accessed by privately used front doors for access to internal stairways associated with the privately used front doors. Second and third floor privately used front doors are disposed on an opposite-facing portion from the front-facing portion. The internal stairways are secluded and only accessible by the dwelling unit tenant. All third-floor unit front doors are located on intermediate landings on the second-floor, which are accessed by semi-private monumental stairways. The above-described configuration avoids the need to provide a common breezeway and stairwells.

According to some embodiments, the second-floor units optionally include storage units or garages located on the first-level of the building. Such storage units include an entrance directly connected to the second-floor unit. Accordingly, access to the second-floor units is provided by a private stairway connected to both a private front door and a storage unit door.

According to some embodiments, multiple multistory residential buildings are disposed side-by-side to form a multistory residential complex. In a complex, adjacent buildings share a common wall, a monumental stairway, and an intermediate landing in order to maximize utilize the lot on which the complex is constructed.

The foregoing and other features and advantages of the present disclosure will become further apparent from the following detailed description of the embodiments, read in conjunction with the accompanying drawings. The detailed description and drawings are merely illustrative of the disclosure, rather than limiting the scope of the disclosure as defined by the appended claims and equivalents thereof.

BRIEF DESCRIPTION OF THE DRAWINGS

Embodiments are illustrated by way of example in the accompanying figures, in which like reference numbers indicate similar parts, and in which.

DETAILED DESCRIPTION

Figure 1:
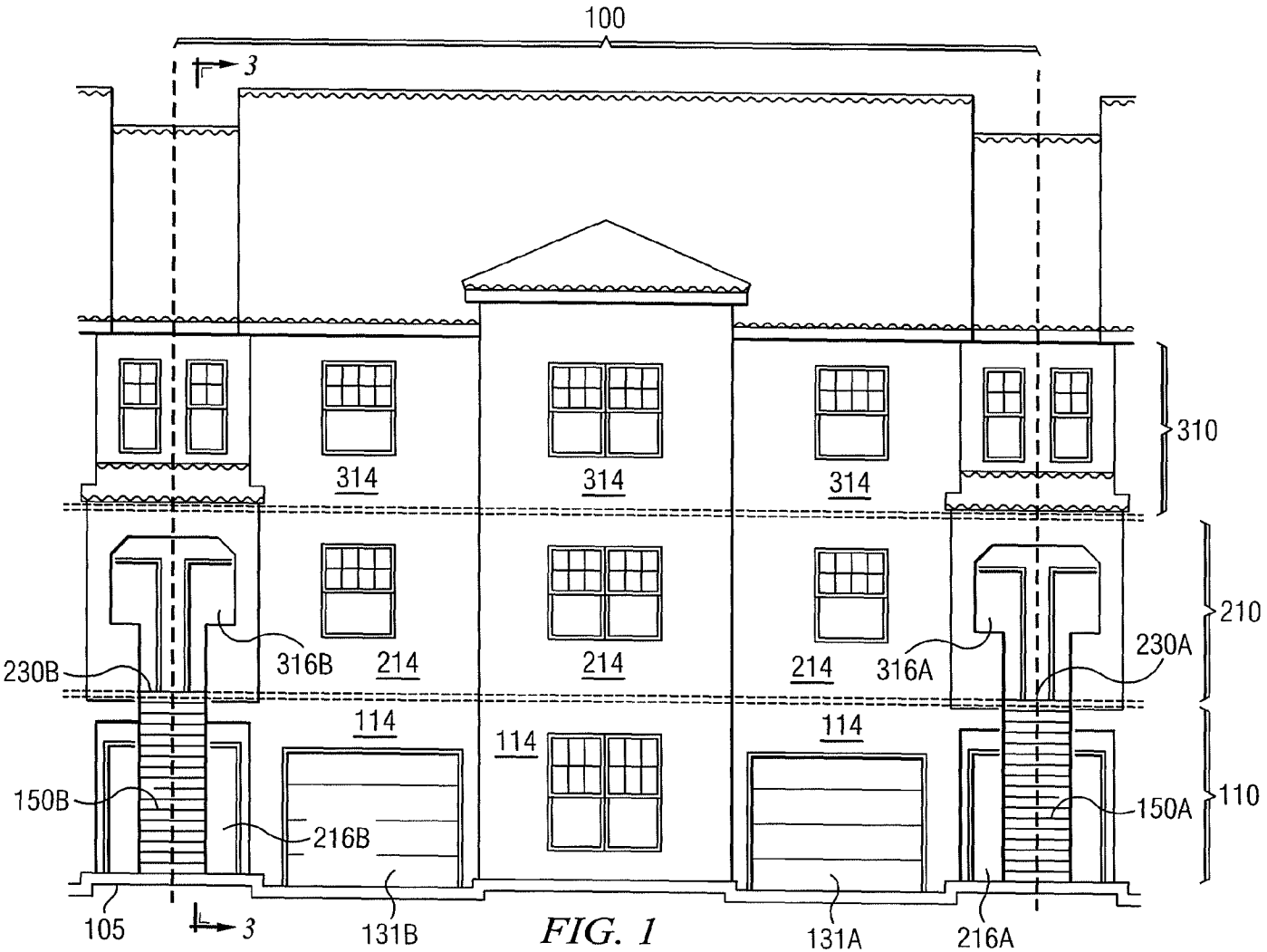
FIG. 1 is a front elevation view of a multistory residential building.
Figure 2:
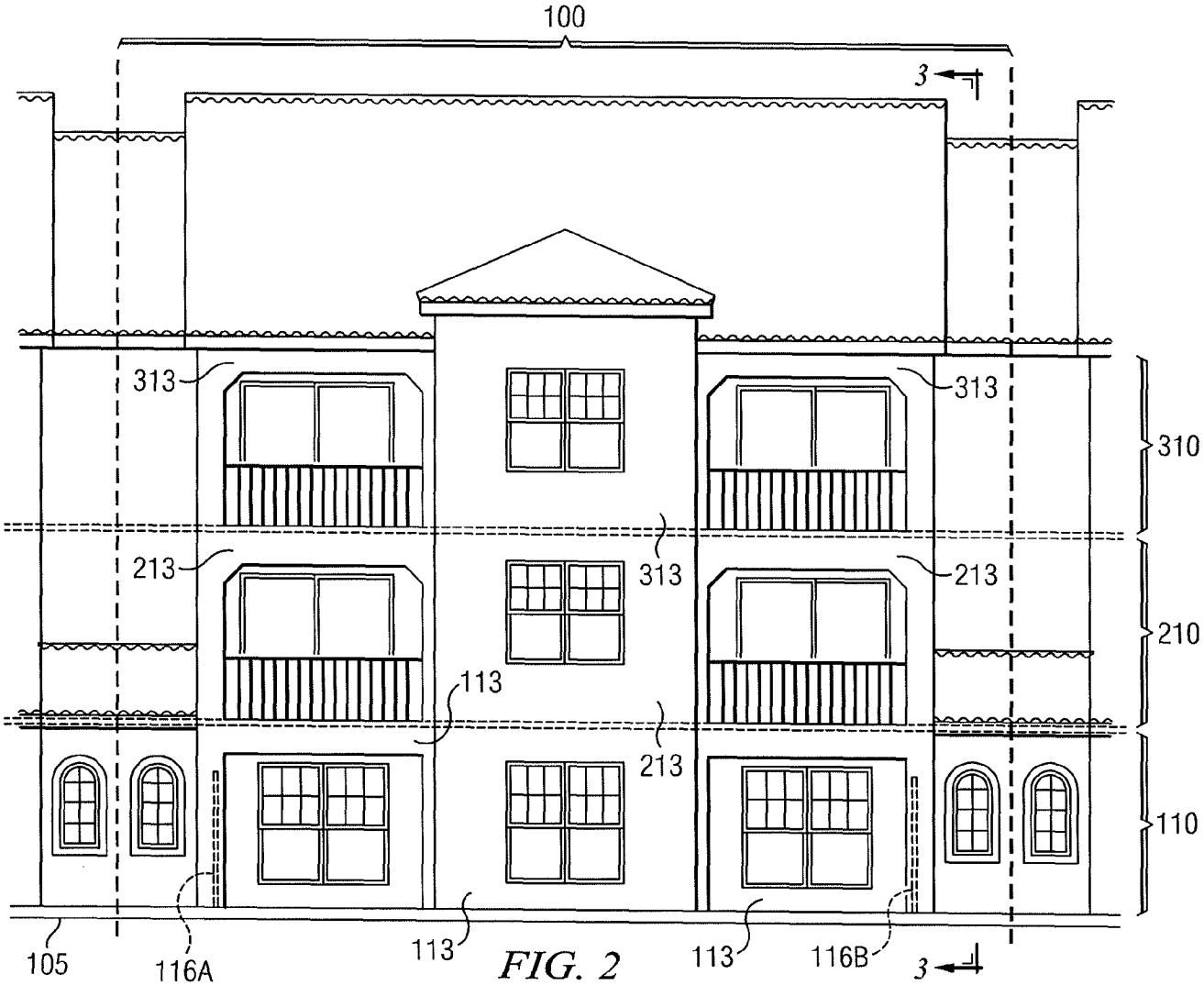
FIG. 2 is a rear elevation view of the multistory residential building illustrated in FIG. 1.

In the description which follows, like features or elements are marked throughout the specification and drawings with the same reference numerals, respectively. The drawing figures may not be to scale in the interest of clarity and conciseness.

The drawing figures illustrate a typical three story architecture for a multistory residential building in accordance with the present disclosure. The disclosed multistory residential building enable access to each dwelling unit without the need for breezeways and common stairwells.

Referring to FIGS. 1-6, a multistory residential building is illustrated and generally designated by the numeral 100. The building 100 comprises a first level 110 disposed at ground level 105, a second level 210 disposed above the first level 110, and a third level 310 disposed above the second level 210. A pair of dwelling first-floor units 115A and 115B (FIG. 4) are located on the first level 110 and are accessed by privately used front doors or entranceways 116A and 116B located on first level 110. A pair of second-floor dwelling units 215A and 215B (FIG. 5) are located at least partially on the second level 210 of the building 100, and are accessed by privately used front doors or entranceways 216A and 216B, which are located on the first level 110 of the building 100. Private stairways 220A and 220B lead from the front doors or entranceways 216A and 216B to the second level 210. A pair of third-floor dwelling units 315A and 315B are located at least partially on the third level 310 of the building 100, and are accessed by front doors or entranceways 316A and 316B located on the second level 210. Private internal stairways 320A and 320B provide a passageway from entranceways 316A and 316B to third level 310. Monumental stairways 150A and 150B, disposed outside of building 100 to provide direct access from entranceways 316A and 316B to ground level 105.

Figure 4:
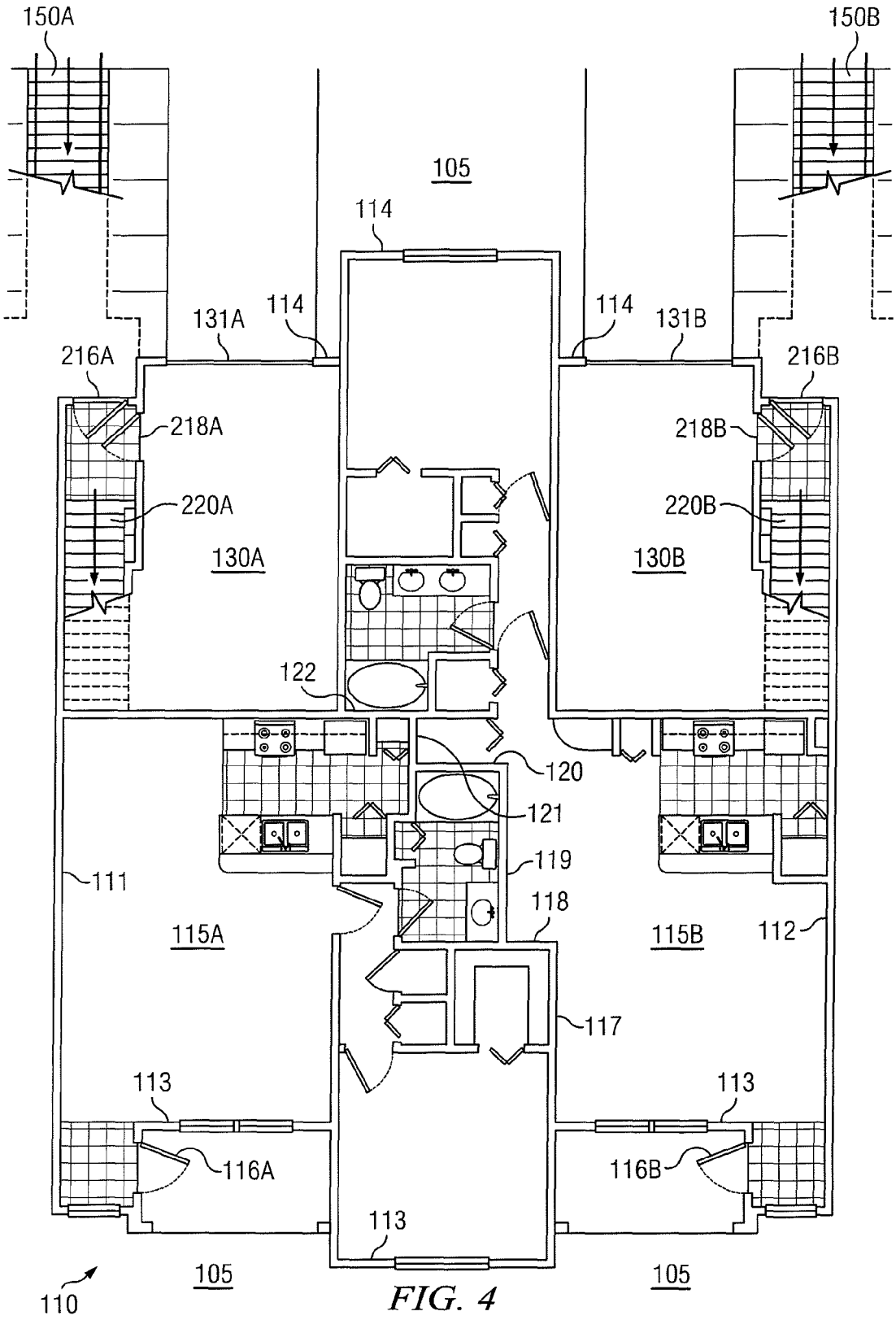
FIG. 4 is an plan view of the first level of the multistory residential building illustrated in FIG. 1.

Referring specifically to FIG. 4, the first level 110 of the residential building 100 is delimited by opposed sidewalls 111 and 112 and opposed end walls 113 and 114. In FIG. 4, first level 110 is, by way of example, divided into two first-floor units 115A and 115B sharing common walls 117-122; however, it should be understood that a greater or fewer number of first-floor units can be constructed.

Figure 3:
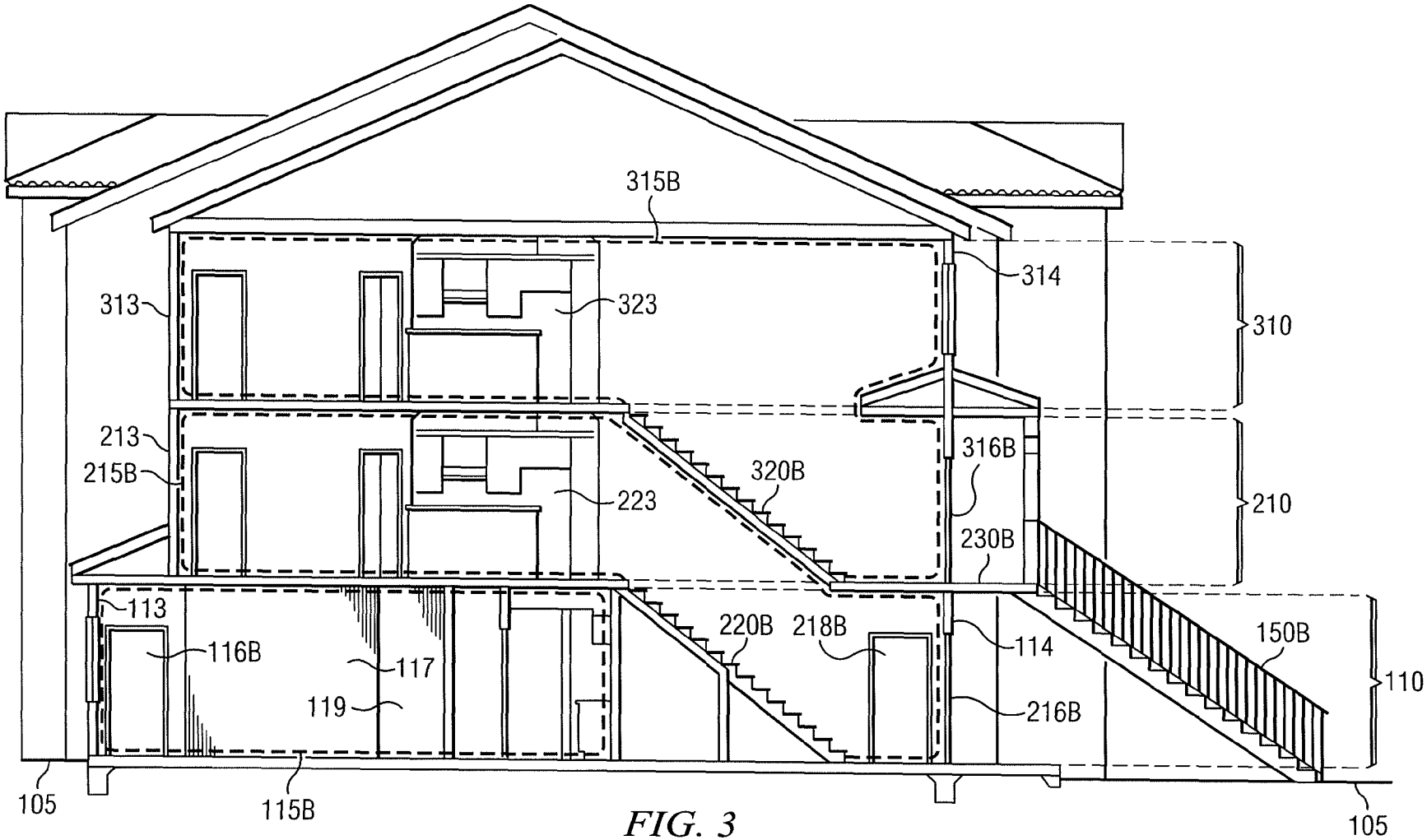
FIG. 3 is a cross-section view of the multistory residential building illustrated in FIG. 1, taken along the line 3-3 of FIG. 1.

The first level 110 also includes private stairways 220A and 220B forming private passageways from ground level 105 to second level units 215A and 215B, respectively. Private stairway 220A is disposed along sidewall 111 and is accessible by private front door 216A which is disposed along end wall 114. Private stairway 220B is disposed along sidewall 112 and is accessible by private front door 216B which is disposed along end wall 114. Private front doors 216A and 216B are disposed on ground level 105 provide direct outside access as illustrated in FIGS. 1, 3, and 4.

According to one aspect disclosed herein, the first level 110 of the building 100 further includes garages on storage units 130A and 130B. Storage unit barriers 131A and 131B provide access through end wall 114 to storage units 130A and 130B, respectively. Storage unit 130A is interconnected with second-floor unit 215A via storage unit door or entranceway 218A and private stairway 220A. Additionally, storage unit 130B is interconnected with second-floor unit 215B via storage unit door 218B and private stairway 220B.

Figure 5:
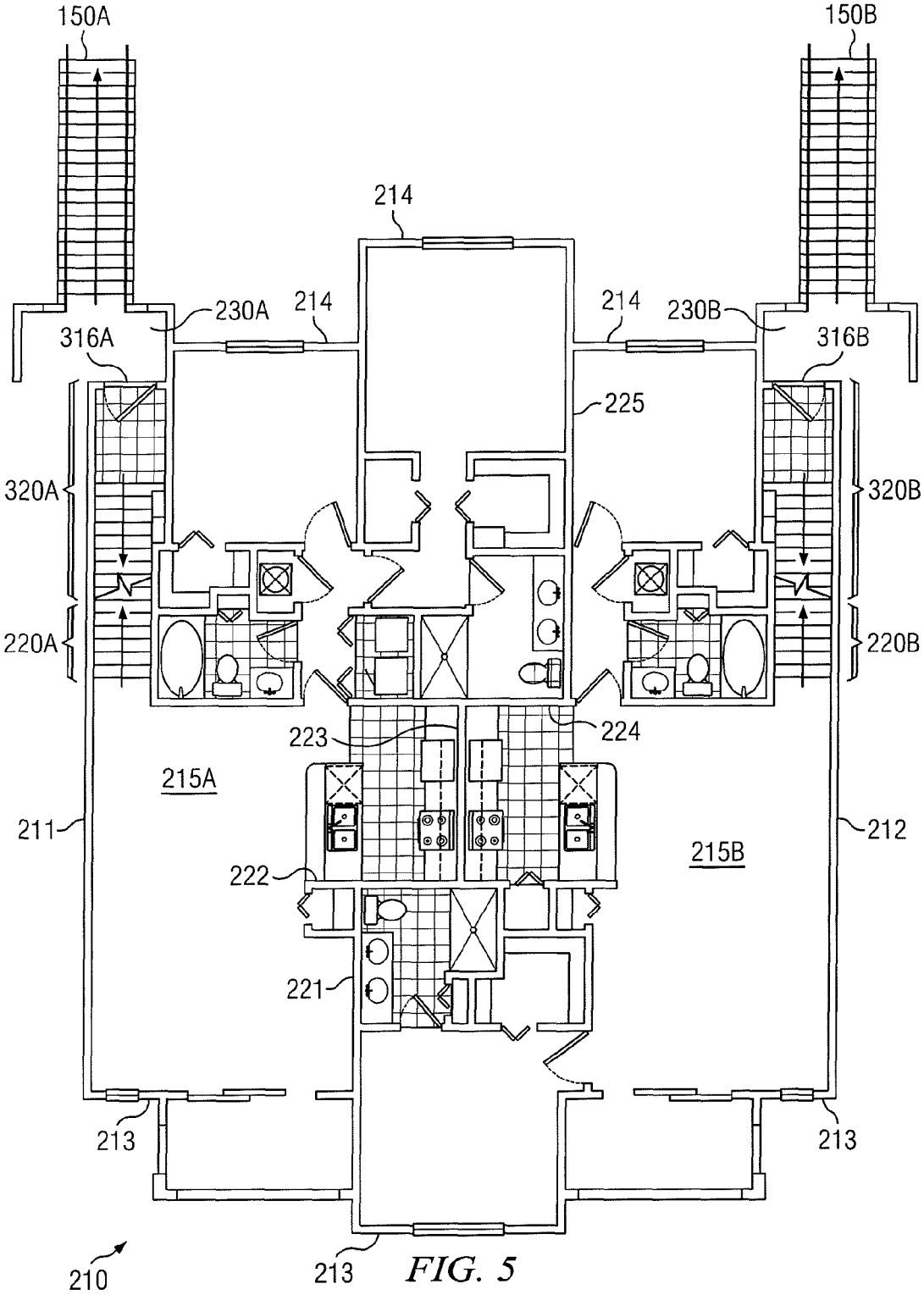
FIG. 5 is a plan view drawing of the second level of the multistory residential building illustrated in FIG. 1.

The private stairways 220A and 220B illustrated in FIG. 4 form a part of second-floor units 215 located on the second level 210 of the residential building 100 and thus increase the amount of rentable space. As illustrated in FIG. 5, the second level 210 of the building 100 is delimited by opposed sidewalls 211 and 212 and opposed end walls 213 and 214. Furthermore, second level 210 is divided into two second-floor units 215A and 215B sharing common walls 221-225; however, it should be understood that a greater or fewer number of second-floor units can be constructed.

Access to second-floor units 215A and 215B is provided by private front doors or entranceways 216A and 216B disposed on first level 110. In some embodiments, access to second floor units is also provided by storage unit doors 218A and 218B. Accordingly, second-floor units 215A and 215B include private stairways 220A and 220B leading from the private front doors 216A and 216B and storage unit doors 218A and 218B, thereby eliminating the need for a breezeway or common stairway and providing secure and private access to second-floor units 215A and 215B. In addition, because the private stairways 220A and 220B are located within the second-floor units 215A and 215B, respectively, they are used exclusively by their respective residents to access the second level 210 of the building 100; accordingly, stairways 220A and 220B form a part of respective floor plan rentable area.

As illustrated in FIG. 5, the second level 210 of the building 100 further includes private stairways 320A and 320B and semi-private intermediate landings 230A and 230B, wherein the intermediate landings 230A and 230B include respective private front doors 316A and 316B. End wall 214 along with corresponding end wall 114 and end wall 314 form a face of the building 100 (see FIGS. 1 and 3). Doors 316A and 316B provide access to the private stairways 320A and 320B, respectively. Intermediate landings 230A and 230B are accessible from ground level 105 by outside, or external, semi-private monumental stairways 150A and 150B. Monumental stairways 150A and 150B provide semi-private access to the intermediate landings 230A and 230B, respectively, whereupon a resident may access its private front door 316A or 316B leading to a private stairway 320A or 320B. Monumental stairways or external stairways 150A and 150B extend beyond the face of the building.

The monumental stairways 150 and intermediate landings 230 are considered semi-private because, depending upon the layout of the building 100, an intermediate landing 230 may provide access to one or two private front doors 316. However, even though the intermediate landings 230 and monumental stairways 150 may be shared by two residents, they are still considered private because they are disposed such that they are not typically used by anyone other than those residents whose front doors are located on the intermediate landing.

The front doors 316A and 316B located at respective intermediate landings 230A and 230B are private, and thus, the internal stairways 320A and 320B providing access from the private front doors 316A and 316B to the respective third-floor units 315A and 315B are also private. Accordingly, the monumental stairways 150A and 150B and private stairways 320A and 320B provide access to the third-floor units 315A and 315B without the dangers and inconveniences associated with common stairwells and breezeways and provide for additional rentable space.

Figure 6:
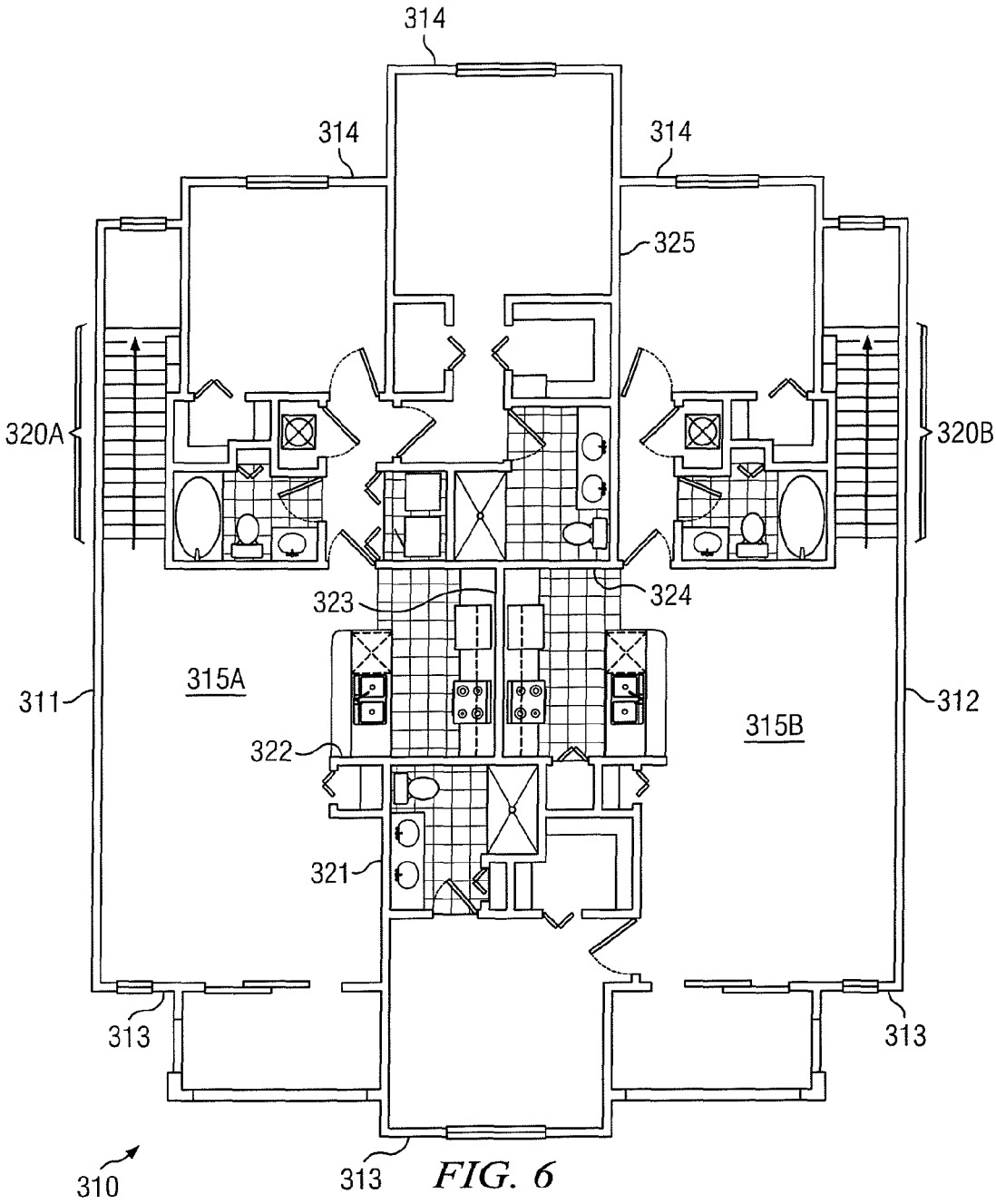
FIG. 6 is a plan view drawing of the third level of the multistory residential building illustrated in FIG. 1.

As disclosed above, the private stairways 320A and 320B illustrated in FIG. 5 lead to and are included in the third-floor units 315A and 315B of the residential building 100. As illustrated in FIG. 6, the third level 310 of the building 100 is delimited by opposed sidewalls 311 and 312 and opposed end walls 313 and 314. In the present embodiment the third level 310 is also divided into two third-floor units 315A and 315B sharing common walls 321-325; however, it should be understood that a greater or fewer number of third-floor units can be constructed.

Access to the private front doors 316A and 316B of the third-floor units 315A and 315B is provided by monumental stairways 150A and 150B and intermediate landings 230A and 230B, wherein front doors 316A and 316B are located on intermediate landings 230A and 230B, respectively. Additionally, third-floor units 315A and 315B include private stairways 320A and 320B leading from respective private front doors or entranceway 316A and 316B, thereby eliminating the need for a breezeway or common stairway and providing clearly visible, secure and private access to the third-floor units 315A and 315B. In addition, because the private stairways 320A and 320B are located within the third-floor units 315A and 315B, they are used exclusively by their respective residents to access the third level 310 of the building 100 and may be considered within the units' floor plans.

Access to each unit of the multistory residential building disclosed herein is considered private because the entrances of the units are not located or otherwise accessible via a public or common location such as a breezeway. Additionally, residents living on the second and third floors are not required to access their respective units through use of a common stairwell. Instead, the stairways leading to their units are secluded and inaccessible to other residents and guests. Additionally, passage to the stairways and unit entrances is in direct view of open areas (e.g., a parking lot) thereby eliminating hidden spaces and potential safety concerns. Although some residents living on the third floor may share use of an external monumental stairway and intermediate landing, the monumental stairway and intermediate landing are still considered semi-private because they are disposed so that they are used by residents whose front doors are located on the intermediate landing; therefore, the monumental stairways and intermediate landings are not considered public locations. In contrast, a common stairwell is disposed in a location so as to provide access to the breezeways or unit entrances on each floor of a building, and thus the common stairwell and breezeways are accessible by all residents and guests thereby making them public locations.

Figure 7:
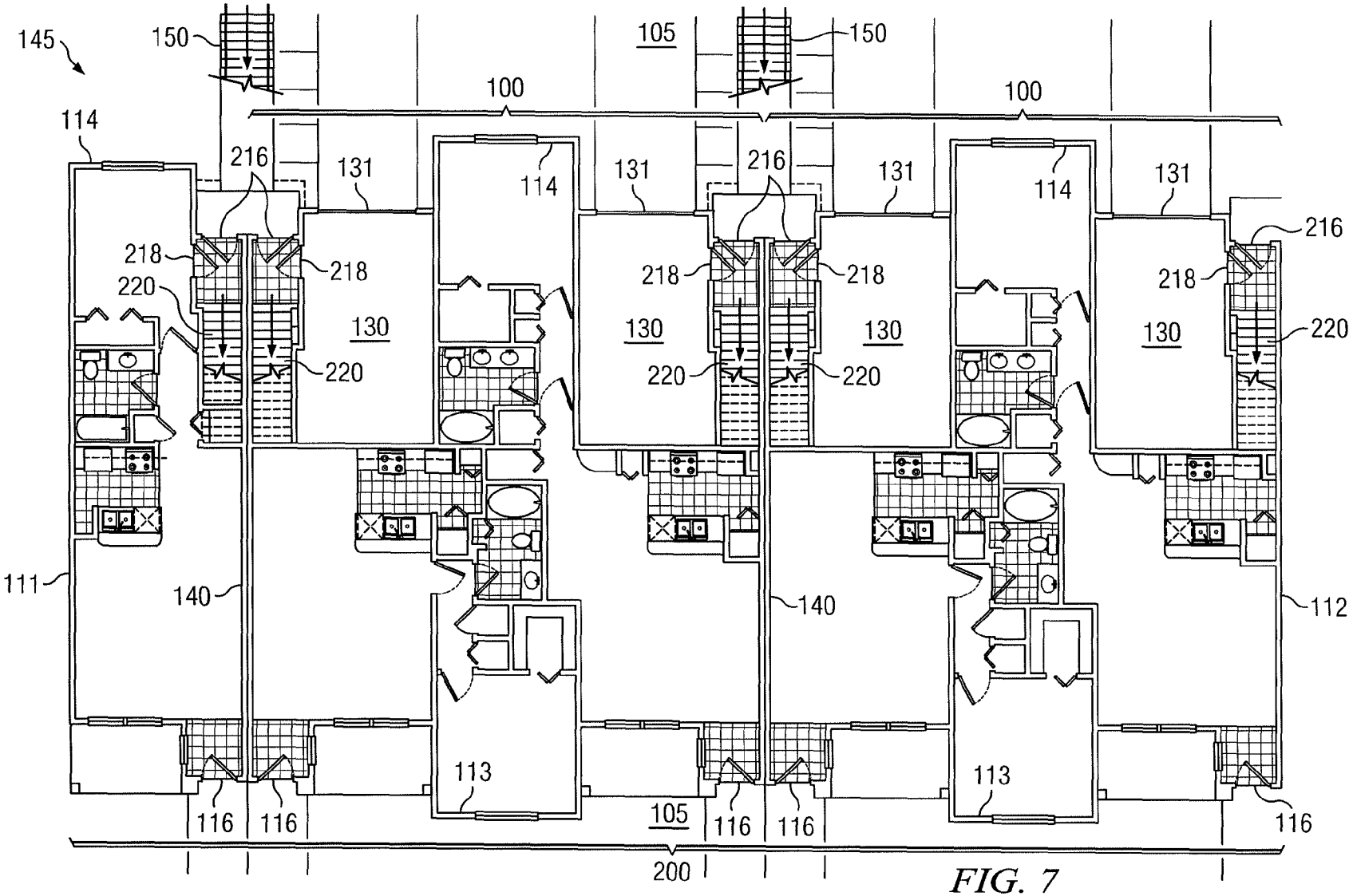
FIG. 7 is a plan view drawing of the first level of a multistory residential complex.
Figure 8:
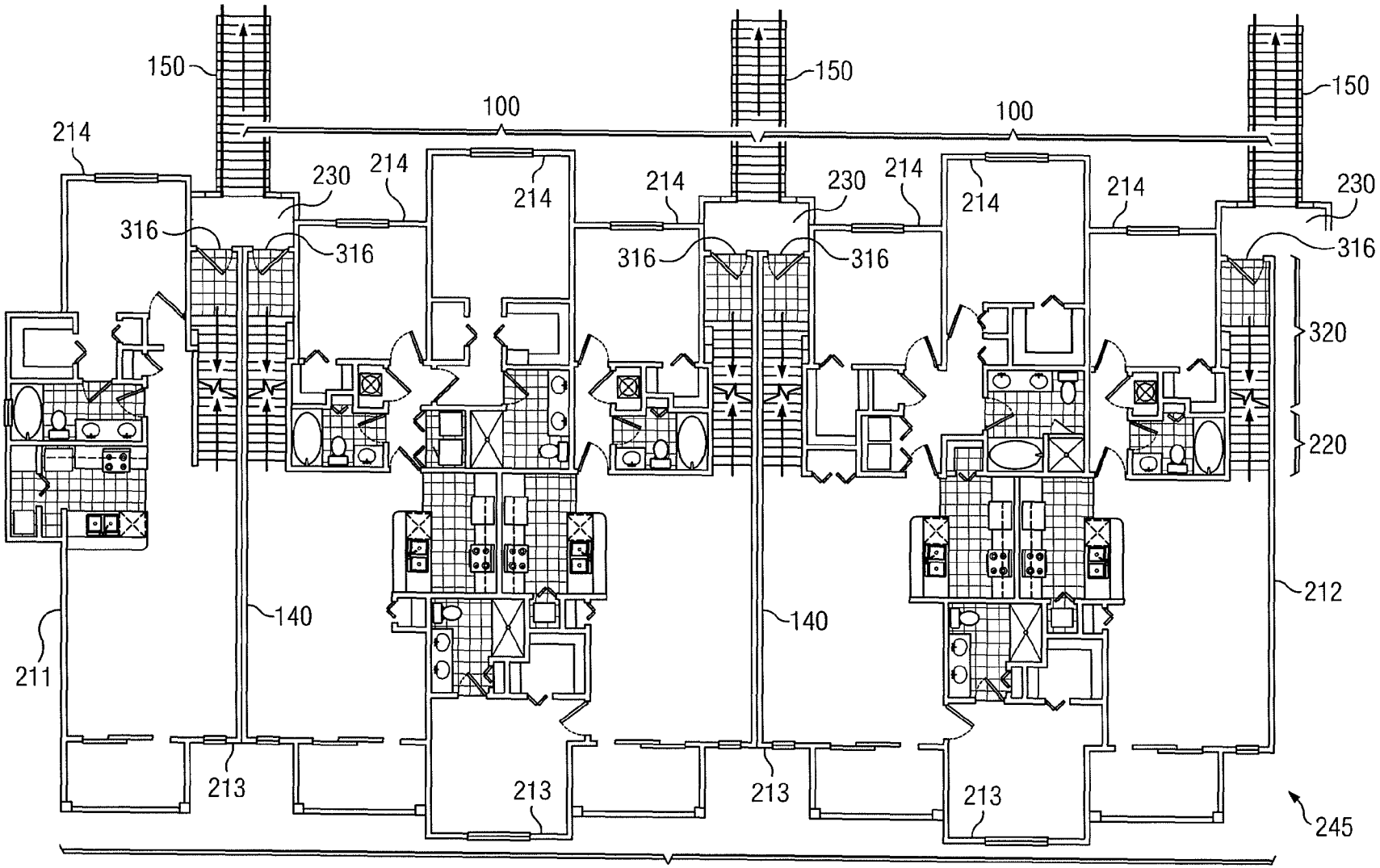
FIG. 8 is a plan view drawing of the second level of a multistory residential complex.
Figure 9:
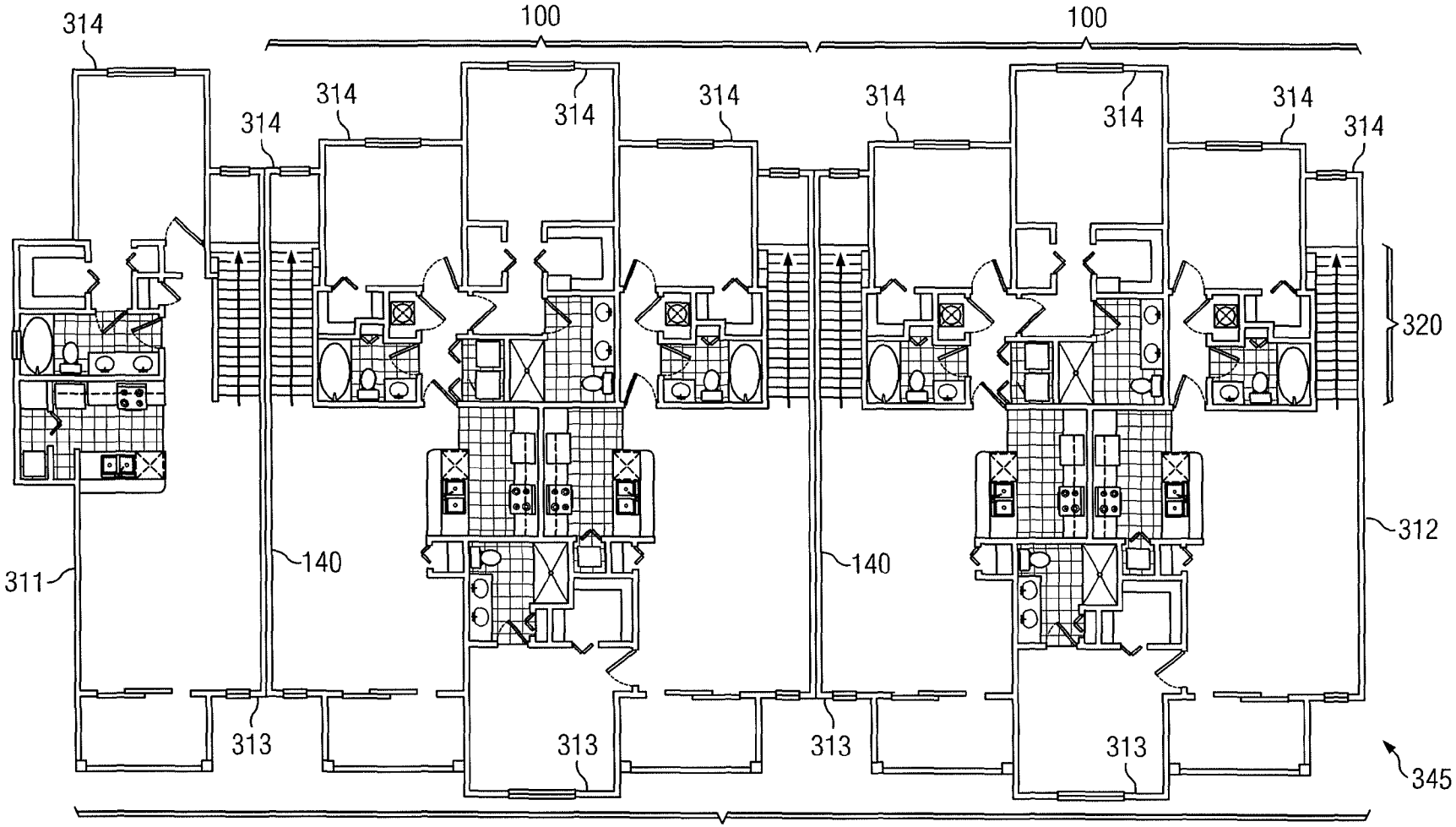
FIG. 9 is a plan view drawing of the third level of a multistory residential complex.

In an embodiment of the present disclosure, multiple multistory residential buildings 100 may be disposed side-by-side to form a multistory residential complex 200, as illustrated in FIGS. 7-9. In a complex 200, adjacent buildings 100 share a common wall 140, monumental stairway 150, and intermediate landing 230. FIGS. 7, 8, and 9 provide plan views of the first 145, second 245, and third 345 floors, respectively, of a complex 200, wherein said first 145, second 245, and third 345 floors comprise the first 110, second 210, and third 310 floors, respectively, of multiple buildings 100 disposed side-by-side. Accordingly, a complex 200 may comprise multiple buildings 100, thereby achieving more efficient use of the property.

What is claimed is:

1. A multistory residential building, comprising:

a first dwelling unit located on a first level, said first dwelling unit accessible from a first entranceway located on said first level;

a second dwelling unit located on a second level above said first level, said second dwelling unit comprising a private stairway connecting said second dwelling unit to said first level and accessible from a second entranceway located on said first level;

a third dwelling unit located on a third dwelling level above said second level, said third dwelling unit comprising a private stairway connecting said third dwelling unit to an intermediate landing located on said second level and accessible from a third entranceway located on said intermediate landing;

an external stairway located outside said multistory building and connecting said intermediate landing to said first level, the entirety of a second external stairway associated with said multistory residential building being viewable from said external stairway; and wherein said first and second unit private stairways are located inside said multistory building and are shielded from public view.

2. The multistory residential building of claim 1, wherein:

said first entry is located on the first outermost side of the building, and said second and third entries are located on the second outermost side of the building opposite the first side.

3. The multistory residential building of claim 2, wherein:

said intermediate landing and said external stairway are located on said second outermost side of the building opposite said first outermost side of the building.

4. The multistory residential building of claim 1, wherein:

said first level further comprises a storage unit.

5. The multistory residential building of claim 4, wherein:

said storage unit is disposed adjacent said first unit and said second unit private stairway.

6. The multistory residential building of claim 4, wherein:

said second unit private stairway is accessible from an entry connected to said storage unit.

7. The multistory residential building of claim 1, wherein:

two third entries are located on said intermediate landing.

8. A multistory residential building, comprising:

a first dwelling unit located on a first level, said first dwelling unit accessible from a first entranceway located on said first level, said first dwelling unit extending from a first outermost side of the residential building to a second and opposite outermost side of the residential building;

a storage unit located on said first level and disposed adjacent said first unit;

a second dwelling unit located on a second level above said first level, said second dwelling unit comprising an internal stairway connecting said second dwelling unit to said first level and accessible from second and third entranceway entries located on said first level, said second dwelling unit extending from said first outermost side of the residential building to said second and opposite outermost side of the residential building;

a third dwelling unit located on a third level above said second level, said third dwelling unit comprising an internal stairway connecting said third dwelling unit to an intermediate landing located on said second level and accessible from a fourth entranceway entry located on said intermediate landing, said third dwelling unit extending from said first outermost side of the residential building to said second and opposite outermost side of the residential building;

an external stairway located outside said multistory building and connecting said intermediate landing to said first level, the entirety of a second external stairway associated with said multistory residential building being viewable from said external stairway; and wherein said third entranceway is connected to said storage unit.

9. The multistory residential building of claim 8, wherein:

said first entranceway is located on said first outermost side of the building, and said storage unit and second and fourth entranceways are located on said second outermost side of the building opposite the first side.

10. The multistory residential building of claim 9, wherein:

said intermediate landing and said external stairway are located on said second outermost side of the building opposite said first outermost side of the building.

11. The multistory residential building of claim 8, wherein:

said storage unit is disposed adjacent said second dwelling unit internal stairway.

12. The multistory residential building of claim 8, wherein:

two fourth entranceways are located on said intermediate landing.

13. A multistory residential complex, comprising:

a plurality of multistory residential buildings disposed side-by-side, each multistory building having opposed first and second opposed outermost end walls and a pair of sidewalls, each of said multistory residential buildings comprising:

a first dwelling unit located on a first level, said first dwelling unit accessible from a first entranceway located on said first level;

a second dwelling unit located on a second level above said first level, said second dwelling unit comprising a first internal stairway connecting said second dwelling unit to said first level and accessible from a second dwelling entry located on said first level;

a third dwelling unit located on a third level above said second level, said third unit comprising a second internal stairway connecting said third dwelling unit to an intermediate landing located on the second level and accessible from a third entranceway located on said intermediate landing;

an external stairway located outside said multistory residential building and connecting said intermediate landing to said first level; and wherein each external stairway is visible from the other external stairway.

14. The multistory residential complex of claim 13, wherein:

said multistory residential buildings further comprise a storage unit disposed adjacent said first dwelling unit.

15. The multistory residential complex of claim 14, wherein:

said first private stairways are further accessible from fourth entries disposed between said first private stairways and said storage units.

16. The multistory residential complex of claim 15, wherein:

said storage units are disposed on said opposed second outermost end wall of the complex opposite said opposed first outermost end wall.

17. The multistory residential complex of claim 16, wherein:

said intermediate landings and said external stairways are located on said opposed second outermost end wall of the building opposite said opposed first outermost end wall of the building.

18. The multistory residential complex of claim 13, wherein:

only one third entry is located on at least one of said intermediate landings.

19. A tri-level residential building, comprising:

a first dwelling unit located on a first level, said first dwelling unit accessible from a first entranceway located on said first level;

a second dwelling unit located on a second level above said first dwelling unit, said second dwelling unit comprising an interiorly located private stairway, shielded from public view from outside the building, and accessible from a second entranceway located on said first level;

a third dwelling unit located on a third level above said second dwelling unit, said third dwelling unit comprising an interiorly located private stairway, shielded from public view from outside the building, and accessible from a third entranceway located on an intermediate landing;

an exterior stairway, located entirely outside said multistory building, with the entirety of a second exterior stairway associated with said tri-level residential building being viewable from said exterior stairway, and anyone on said exterior stairway, open to public view from any location around the exterior stairway, the exterior stairway extending from said first level to said intermediate landing and accessible to said third entranceway.

* * * * *

UNITED STATES PATENT AND TRADEMARK OFFICE

CERTIFICATE OF CORRECTION

PATENT NO. : 8,474,203 B1
APPLICATION NO. : 12/789034
DATED : July 2, 2013
INVENTOR(S) : Jerry W. Stewart et al.

It is certified that error appears in the above-identified patent and that said Letters Patent is hereby corrected as shown below:

In the Claims:

At column 8, claim number 19, line numbers 12-14, please delete the text "and anyone on said exterior stairway, open to public view from any location around the exterior stairway,"

Signed and Sealed this
Sixth Day of August, 2013

Teresa Stanek Rea
*Acting Director of the United States Patent and Trademark Office*